United States Patent [19]

Pombrol

[11] 4,153,321

[45] May 8, 1979

[54] BATTERY BOOSTER CABLE

[75] Inventor: Rogelio R. Pombrol, Miramar, Fla.

[73] Assignee: Kravex Manufacturing Company, Miami, Fla.

[21] Appl. No.: 778,389

[22] Filed: Mar. 17, 1977

[51] Int. Cl.[2] ..... H01R 11/24

[52] U.S. Cl. ..... 339/95 B; 24/248 R; 339/255 P; 339/261

[58] Field of Search ..... 339/28, 29, 95 B, 255 P, 339/260, 261; 24/248 R, 249 LS, 255 SL; 128/322

[56] References Cited

U.S. PATENT DOCUMENTS

| | | | |
|---|---|---|---|
| 1,999,613 | 4/1935 | Mueller et al. | 339/255 P |
| 2,522,810 | 9/1950 | Bailey | 339/255 P |
| 2,563,236 | 8/1951 | Gragg | 24/248 R |
| 2,644,142 | 6/1953 | Danberg | 339/255 P |

OTHER PUBLICATIONS

Scientific American, White, Feb. 1911, pp. 140, 339–255 P.

*Primary Examiner*—Joseph H. McGlynn
*Attorney, Agent, or Firm*—Kenyon & Kenyon, Reilly, Carr & Chapin

[57] ABSTRACT

A battery booster cable clamp includes first and second members each containing an arm and a jaw joined in the nature of pliers with one arm containing an upwardly extending flexible member containing a plurality of teeth engaging a projection on the end of the other arm to achieve a ratchet action, electrically conductive teeth being disposed at each of the jaws whereby bringing the arms together will bring the jaws together to permit clamping the teeth on a battery post or terminal.

7 Claims, 6 Drawing Figures

Fig. 1.
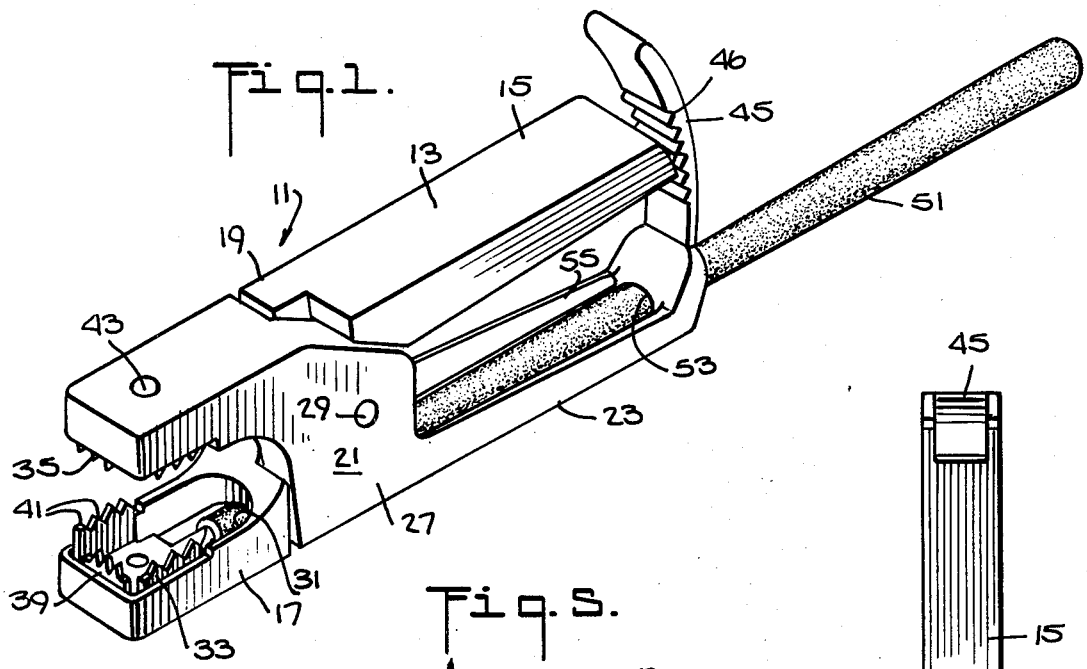
Fig. 5.
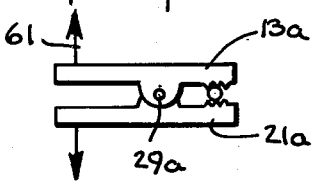
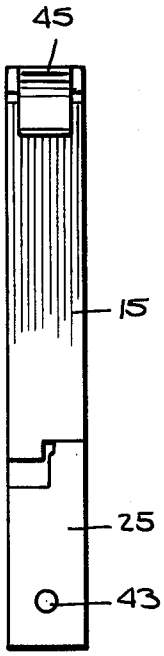
Fig. 4.
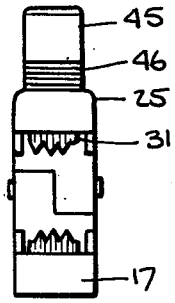
Fig. 3.
Fig. 6.
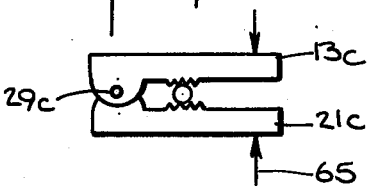
Fig. 2.
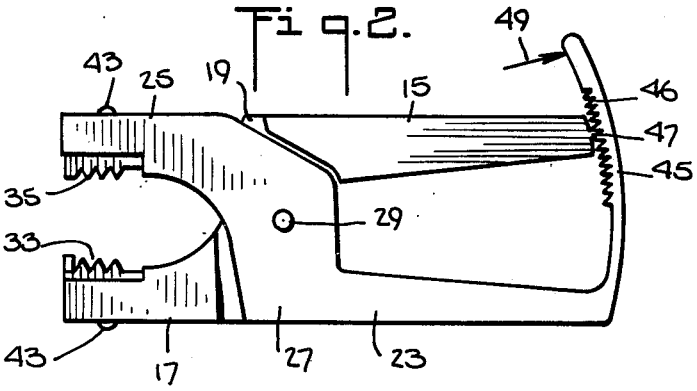

BATTERY BOOSTER CABLE

BACKGROUND OF THE INVENTION

This invention relates to automobile electrical systems in general and more particularly to a battery booster cable having an improved type of clamp thereon.

Presently used battery booster cables generally include a spring loaded clamp made of copper or aluminum and having clamping surfaces on one end therof which are serrated. The two halves of the clamp are hinged together with the clamping surfaces which are placed around the battery post or terminal on one side of the hinge and a spring disposed on the other side to tend to bias the clamping surfaces together. Typically nonconductive covers are placed around the ends of the two halves of the clamp behind the hinge. The battery cable is attached to one of the halves at the back thereof, i.e., at the side opposite the side containing the serrations which engage the battery post or terminal.

These clamps are used on jumper-type cables which are used to conduct current from one battery to another for starting a car having a dead battery and are also used with battery chargers for recharging a battery. The clamps presently used suffer from a number of disadvantages. The most important of these is that it is quite difficult in some cases to get a good solid grip on the battery post or terminal. The clamps have a tendency to slip off causing difficulties. Furthermore, since the clamps are made completely of metal they constitute a shock hazard to the user and are relatively expensive to manufacture because of the high cost of copper or aluminum. A further disadvantage is that there is very little strain relief at the point where the cable is connected to the clamp. It is not at all uncommon for the cable to break off at this point. Generally this occurs gradually with individual wires in the cable, the cable normally being made of a plurality of twisted wires, breaking one at a time. As a result, even before the cable breaks off completely, the current carrying capability becomes substantially reduced and, in the case of jump starting, at some point insufficient current to start an automobile can no longer be carried. Current carrying capability also comes into play with regard to the type of contact which is made between the clamp and the battery post or terminal. If good contact is not made the current cannot readily pass from one to the other and difficulties arise.

Thus, there is a need for an improved battery booster cable, in particular a need for an improved clamp which will, in each case, firmly grip the battery post or terminal, which is inexpensive to manufacture, and which minimizes the possibility of the cable breaking off from the battery clamp.

SUMMARY OF THE INVENTION

The present invention provides a clamp and a battery cable which satisfies all of these requirements.

Although a number of different embodiments are possible, the preferred embodiment uses a clamp having a design similar to conventional pliers. The two halves or members of the clamp are joined together for relative rotation therebetween. On the end corresponding to the jaws of a pliers are disposed electrically conductive members containing a plurality of teeth for engaging the battery post or terminal. Preferably teeth are provided around the whole periphery of the jaw portion of the clamp, i.e., at least on three sides. Rather than spring loading this device as was done in the past, a ratchet arrangement is utilized in which a biased flexible member containing serrations extends out from one of the arms of the plier mechanism on the end opposite the jaws and engages a projection on the end of the other arm. The extending flexible member is biased toward the jaws so that, as the two arms of the pliers are brought together and it concurrently clamps the jaws about a battery post or terminal, the successive serrations are engaged and hold the jaws together. To release the jaws it is only necessary to pull back on the flexible member. Preferably the two halves of the plier-like clamp are made of plastic and the conductive portion necessary for engaging the battery terminal provided as an insert to these plastic members at the jaw end. Furthermore, these conductive members preferably contain a plurality of small teeth to permit being able to engage terminals of any size. In this preferred embodiment, the cable extends through and inside one of the arms of the plier mechanism and is attached to the conductive member at the jaw. By so passing the cable through the arm of the plier member, strain relief is provided and there is much less likelihood that it will break off from the conductive member than in clamps presently is use.

A number of alternative embodiments are disclosed, each operating on basically the same principle. This principle requires that there be two members of an elongated nature hinged together so at to permit relative movement therebetween at at least one end thereof, with that one end containing thereon conductive teeth portions for engaging a battery post or terminal and that there be provided between the two elongated members a ratchet mechanism which includes a biased flexible member with serrations extending from one member and an engaging projection on the other. Furthermore, different materials may be used in constructing the clamp of the present invention. Although plastic with a conductive inset is preferred, it would be possible to make the whole mechanism of metal. Of course doing so would take away one of the advantages of the clamp, in that its cost would be increased. However, from a functional standpoint it would still be completely operational.

BRIEF DESCRIPTION OF THE DRAWINGS

FIG. 1 is a perspective view of a preferred embodiment of the battery cable clamp of the present invention.

FIG. 2 is a side elevation view of the clamp of FIG. 1

FIG. 3 is a front elevation view of the clamp.

FIG. 4 is a plan view of the clamp.

FIGS. 5 and 6 are schematic illustrations of possible alternate embodiments of the battery clamp of the present invention.

DETAILED DESCRIPTION OF THE INVENTION

FIGS. 1–4 illustrate the preferred embodiment of the present invention. The clamp 11 includes a member 13 having on one end thereof an arm 15 and on the other end a jaw 17. Joining the jaw 17 and the arm 15 is a narrowed portion 19 which has a width essentially half that of the jaw and arm. The portion 19 extends essentially perpendicualr to the portions 15 and 17 so that, as is most clearly illustrated by FIG. 2, the arm 15 is disposed above the jaw 17. A second similar member 21 includes an arm 23 and a jaw 25. The jaw and arm are joined by a portion 27 also extending essentially vertically and of a width half that of the jaw 25 and arm 23. As illustrated, the two parts 21 and 13 mate together and are attached for rotation by means of a rivet 29 or the like. The resulting structure is in the form of the conventional pliers. Preferably, the members 13 and 21 are made of a suitable plastic material. This can be a chemically set material, a thermoset material or other type of molded plastic. As illustrated, each of the jaws 17 and 25 contains a recess 31. In the recess of the jaw 17 is disposed a conductive member 33. Similarly, in the recess 31 of jaw 25 is a conductive member 35. The conductive members 33 and 35 each include a flat base 37 with vertically extending portions 39 on three sides thereof. Each of the vertically extending portions 39 contain a plurality of small teeth 41 for engaging a battery post or terminal. As illustrated, the conductive members 33 and 35 are attached to the jaws 17 and 25 means of suitable rivets 43. They are disposed such that one of the vertical extensions 39 is at the front of the jaw and the other extensions on the side of the jaw. The arms 23 and 15 are also recessed. At the rear end of the arm 23 is a flexible member 45 extending upward in an arcuate manner. Flexible member 45 contains thereon a plurality of serrations 46. The end of the arm 15 contains thereon a projection 47 to engage these serrations 46. This establishes the ratchet mechanism. The flexible member 45 is of a thickness such that it will be slightly flexible and is molded so as to be biased against the arm 15. However, application of force in the direction of the arrow 49 will remove the serrations 46 from engagement with the projection 47 to permit free movement of the arm 15 with respect to the arm 23. A cable 51 extends through an appropriate opening 53 in the back of the arm 23 and is conducted in the recess 55 therein to the conductive member 33 where it is attached in conventional fashion. For this purpose, the conductive member 33 can contain tabs on its end for crimping about the cable 51. Appropriate holes are formed through the jaw 17 and recesses formed in the area of the vertical members 19 and 27 to permit passage of the cable 51 therethrough.

In operation, pressure is applied in the direction of the arrow 49 and the arms 15 and 23 moved apart, at the same time moving apart the jaws 17 and 25, until the jaws are far enough apart to exceed the dimensions of the battery post or terminal on to which the clamp is to be placed. Thereupon, the user places the clamp about the post or terminal using the teeth on any of the sides 39 for purposes of engagement. He then presses the arms 15 and 23 together and in doing so successively engages the serrations or teeth 46. He continues applying pressure until the clamp is tightly on the post or terminal whereupon he releases the pressure on the arms. At this point the projection 47 will be engaging one of the teeth 46 and will maintain the conductive portions 33 and 35 tightly in contact with the post and terminal. Since a spring is not relied upon and since small teeth are used, an extremely good contact is made which will not come loose even in the face of vibration and movement of the cable. Because of the construction of the pliers mechanism, slight forces against the clamp will not result in it falling off as is often the case with presently used clamps.

When used as a booster cable, there will, of course, be another similar clamp on the other end of the cable 51. To further improve strain relief, the hole 53 may be made such as to form a tight fit with the cable 51 and, if desired, means may be provided to secure the cable 51 within the recess 55 of the arm 23.

It should be pointed out that, in this embodiment, the member 27 is molded in one piece to contain the jaw 25, arm 23 and flexible member 25. Similarly the piece 13 is molded with the arm 15, jaw 17 and the projection 47 on the end thereof. Once the two parts are molded, they are simply attached using the rivet 29. The cable 51 is inserted, the conductive member 13 crimped thereon, whereupon it is riveted to the jaw 17 and the second conductive member 35 riveted to the jaw 25. Thus, the manufacturing of this clamp is simple and inexpensive. The greatest portion of the clamp is made of a plastic material further reducing cost.

There are, of course, various modifications which could be made to the clamp. For example, the ratchet mechanism 45 could be made separately and attached to the arm 23. This, of course, would take away from some of the economic advantage of, the embodiment of FIGS. 1–4. Another possibility which may further reduce cost would be in molding a ball-type projection in the member 21, for example, and providing a receiving socket in the member 13 permitting the two parts to be snapped together and eliminating the need for the rivet 29.

A number of variations of the basic mechanism of FIGS. 1–4 are possible. For example, as illustrated schematically on FIG. 5, two elongated members **13*a* and 21*a* may be used and hinged together with a force in the direction of arrows 61 used to bring the jaws together. The arrows also indicate the location of the flexible member and projection which cooperate to give a ratchet action. A further possibility is illustrated by FIG. 6 in which the members 13*c* and 21*c* are hinged at a point 29*c* at one end thereof and pressure applied at the arrows 65** to close the jaws. The flexible member and projection of the ratchet mechanism are also located at the point of the arrows. The jaws are located between the flexible member and projection of the ratchet mechanism and the hinge.

In general, it is thought that these other embodiments will only prove useful in specialized applications. For general purposes, in most conventional battery booster cables, whether used as jumper cables to jump from one car to the other or as a portion of a battery charging apparatus or the like, the construction illustrated by FIGS. 1–4 is considered the best mode of the invention. Again with respect to this embodiment it would be possible to make all of the parts of metal. However, although avoiding the necessity for attaching conductive members 33 and 35, more than likely such will increase the cost because of the increased cost of material and presents a safety problem in that the arms of the clamp which must be grabbed by the user are conductive. As a result, protective, insulating coverings on the arms would be necessary as is now the conventional practice. The need to place these on the arms would offset any saving from not having to install the conductive inserts.

What is claimed is:

1. A clamp for a battery booster cable comprising:

(a) a first member having at one end thereof a substantially horizontally extending first arm portion of a first width, an essentially horizontally extending first jaw portion at the other end thereof and a substantially vertical portion of a width approximately half said first width joining said first arm portion and said first jaw portion;

(b) a second member of essentially identical design having a second arm portion and second jaw portion and a second essentially vertical portion, said first and second members placed with their substantially vertical portions in abutting relationship with said first arm portion disposed directly above said second arm portion and said second jaw portion disposed directly above the first jaw portion;

(c) hinging means at said first and second substantially vertical portions joining said first and second members thereby forming a structure in the nature of a pliers whereby relative movement of said arm portions together and away from each other will result in similar movement of said jaw portions;

(d) an arcuate, flexible member extending essentially in a vertical direction from one of said arm portions, said flexible member contain thereon a plurality of teeth pointing in a direction toward said arm portion said flexible member biased in a direction toward said jaw portions;

(e) a projection on the end of said other arm portion adapted to engage said teeth;

(f) a first toothed conductive member disposed at the inside of said first jaw portion, its teeth pointing toward said second jaw portion;

(g) a second conductive member disposed at the inside of said second jaw portion, its teeth pointing toward said first jaw portion, whereby said jaw portions may be separated by applying a force against said flexible member to move it away from said teeth, said jaw portions placed around the battery terminal, said arm portions brought together thereby bringing said jaw portions together to apply a clamping force to said terminal and said jaw portions and arm portions held in position by the ratchet action existing between said teeth on said flexible member and said projection on said other arm portion.

2. Apparatus according to claim 1 wherein said means of attaching said first and second members comprises a rivet passing through said first and second vetical portions.

3. Apparatus according to claim 1 wherein said first and second members are made of a non-conductive plastic material and wherein said first and second toothed conductive members are attached to the ends of the jaw portions of said first and second members.

4. Apparatus according to claim 3 wherein said first and second jaw portions contain recesses therein and wherein said first and second toothed conductive members are disposed within said recesses having their teeth extending out therefrom.

5. Apparatus according to claim 4 wherein said toothed portions each comprise an essentially horizontal base portion and first, second and third vertically projecting portions each containing a plurality of small teeth on the end thereof, said base portions being inserted into said recess in said jaw portions with said vertical portions extending outward therefrom, one of said vertical portions being disposed at the outer end of said jaw portion and, a rivet passing through each of said jaw portions and each of said bases holding said bases against said jaw portions.

6. Apparatus according to claim 5 wherein said flexible member is molded integrally with said one of said first and second members.

7. Apparatus according to claim 6 and further including a recess in at least said one arm portion, a hole through the end of said one arm portion leading to said recess, an opening formed through said vertical portions into the recess of one of said jaw portions and a cable extending through said one arm portion and resting in the recess in said one arm portion and passing through said openings in said vertical portions and extending to said conductive member in said first jaw portion, said conductive member being conductively attached to said cable.

* * * * *